US012297638B2

(12) United States Patent
Binder

(10) Patent No.: US 12,297,638 B2
(45) Date of Patent: May 13, 2025

(54) FRAME, BASIC FRAMEWORK, MODULE, PROFILE AND SET OF STRUCTURAL ELEMENTS FOR MODULAR CONSTRUCTION AND A MODULAR-CONSTRUCTION BUILDING

(71) Applicant: KNAUF GIPS KG, Iphofen (DE)

(72) Inventor: Joachim Binder, Purbach (DE)

(73) Assignee: Knauf Gips KG, Iphofen (DE)

( * ) Notice: Subject to any disclaimer, the term of this patent is extended or adjusted under 35 U.S.C. 154(b) by 1109 days.

(21) Appl. No.: 16/638,954

(22) PCT Filed: Aug. 18, 2017

(86) PCT No.: PCT/EP2017/000997
§ 371 (c)(1),
(2) Date: Feb. 13, 2020

(87) PCT Pub. No.: WO2019/034224
PCT Pub. Date: Feb. 21, 2019

(65) Prior Publication Data

US 2020/0190788 A1 Jun. 18, 2020

(51) Int. Cl.
*E04B 1/34* (2006.01)
*E04B 1/348* (2006.01)
(Continued)

(52) U.S. Cl.
CPC ..... *E04B 1/3483* (2013.01); *E04B 1/388* (2023.08); *E04C 3/07* (2013.01); *E04C 3/32* (2013.01);
(Continued)

(58) Field of Classification Search
CPC ..... E04C 3/07; E04C 2003/0421; E04C 2003/043; E04C 3/32; E04C 2003/0452;
(Continued)

(56) References Cited

U.S. PATENT DOCUMENTS 854,391 A * 5/1907 Voshardt ..... E04C 3/04 52/840
991,603 A * 5/1911 Brooks ..... E04C 3/07 52/364
(Continued)

FOREIGN PATENT DOCUMENTS

AU 2010201674 11/2010
CN 202627207 12/2012
(Continued)

OTHER PUBLICATIONS

Official Action with machine translation for Japan Patent Application No. 2020-509102, dated Jul. 5, 2022, 20 pages.
(Continued)

*Primary Examiner* — Brian E Glessner
*Assistant Examiner* — Adam G Barlow
(74) *Attorney, Agent, or Firm* — Sheridan Ross PC

(57) ABSTRACT

The invention relates to a frame, in particular a wall frame, which is intended for a preferably self-supporting basic framework of a module for modular construction and comprises two post profiles Which can be arranged essentially vertically and of which the upper ends can be connected to one another via a ceiling profile and the lower ends can be connected to one another via a floor profile. The invention also relates to a basic framework, to a module, to a profile and to a set of structural elements for modular construction and also to a modular-construction building.

18 Claims, 5 Drawing Sheets

(51) Int. Cl.
*E04B 1/38* (2006.01)
*E04C 3/07* (2006.01)
*E04C 3/32* (2006.01)
*E04C 3/04* (2006.01)

(52) U.S. Cl.
CPC ..... *E04C 2003/0421* (2013.01); *E04C 2003/043* (2013.01); *E04C 2003/0439* (2013.01); *E04C 2003/0452* (2013.01); *E04C 2003/0465* (2013.01)

(58) Field of Classification Search
CPC .. E04C 2003/0417; E04B 1/3483; E04B 1/40; E04B 1/2403; E04B 2001/2415
USPC ..... 52/106, 238, 239, 637, 646, 648.1, 837, 52/838, 842
See application file for complete search history.

(56) References Cited

U.S. PATENT DOCUMENTS 1,159,526 A * 11/1915 Name ..... E04C 3/26 52/574
1,545,168 A * 7/1925 Schenck ..... E04C 3/07 52/842
1,915,023 A * 6/1933 Lizaso ..... E04B 1/2403 52/648.1
2,065,378 A * 12/1936 Kling ..... E04C 3/07 52/842
3,002,315 A * 10/1961 Kuhn ..... A63H 33/044 52/264
3,073,421 A * 1/1963 Bock ..... E04F 13/0823 52/775
3,083,670 A 4/1963 Harlander et al.
3,132,443 A * 5/1964 Kuhn ..... A63H 33/044 446/112
3,168,793 A * 2/1965 Gibson ..... E04G 1/14 403/175
3,217,659 A * 11/1965 Ford, Jr. ..... B65G 21/22 228/178
3,241,285 A * 3/1966 Baroni ..... E01D 2/02 52/842
3,342,007 A * 9/1967 Merson ..... E04C 3/07 52/364
3,370,389 A * 2/1968 Macaluso ..... E04B 2/7435 52/775
3,396,499 A * 8/1968 Biffani ..... E04B 1/2403 52/845
3,487,518 A * 1/1970 Hopfeld ..... E04C 3/29 273/DIG. 7
3,559,357 A 2/1971 Lowe
3,565,264 A * 2/1971 Guiher ..... A47B 57/402 52/842
3,717,964 A 2/1973 Brown et al.
3,752,511 A 8/1973 Racy
3,822,519 A 7/1974 Antoniou
3,824,750 A 7/1974 Antoniou
3,890,755 A * 6/1975 Specht ..... B65G 21/06 52/645
3,971,172 A * 7/1976 Gentil ..... E04B 1/24 52/28
3,971,179 A * 7/1976 Bodocsi ..... E04B 1/24 52/272
4,002,000 A * 1/1977 Howard ..... B21D 47/01 52/842
4,019,298 A * 4/1977 Johnson, IV ..... E04B 1/185 403/381
4,069,638 A 1/1978 Hasselqvist et al.
4,599,829 A 7/1986 DiMartino, Sr.
4,621,473 A * 11/1986 Wendt ..... E04F 13/0805 52/489.2
4,708,252 A 11/1987 Azzi
4,712,286 A 12/1987 Wolf
5,189,860 A * 3/1993 Scott ..... E04C 3/28 52/690
5,271,204 A * 12/1993 Wolf ..... G09F 15/0068 52/844
5,275,382 A * 1/1994 Charbaut ..... E04H 17/20 256/48
5,291,716 A 3/1994 Broberg et al.
5,353,560 A * 10/1994 Heydon ..... E04B 7/22 52/592.1
5,403,986 A * 4/1995 Goleby ..... E04C 3/07 219/617
5,509,634 A * 4/1996 Gebka ..... G09F 3/204 24/336
5,511,355 A * 4/1996 Dingler ..... E04C 3/07 52/836
5,806,268 A * 9/1998 Koller ..... E04B 1/24 52/843
5,842,318 A * 12/1998 Bass ..... E04C 3/11 403/201
6,038,824 A * 3/2000 Hamrick, Sr. ..... E04B 1/3483 52/143
6,067,691 A * 5/2000 Feltman ..... E04F 13/0733 24/336
6,131,362 A * 10/2000 Buecker ..... E04C 3/07 52/843
6,332,301 B1 * 12/2001 Goldzak ..... E04C 3/10 52/223.13
6,363,586 B1 4/2002 Neufingerl
6,436,552 B1 * 8/2002 Walker ..... E04C 3/09 428/603
6,792,728 B2 * 9/2004 Toulemonde ..... E04B 1/0038 52/309.7
6,826,884 B2 * 12/2004 Pabedinskas ..... E04C 3/29 52/839
6,837,016 B2 * 1/2005 Simmons ..... F16B 9/09 403/219
6,874,765 B2 * 4/2005 Deeley ..... E04H 17/143 256/59
7,310,920 B2 * 12/2007 Hovey, Jr. ..... E04B 1/24 52/656.1
7,546,716 B1 * 6/2009 Asadurian ..... E04C 1/395 52/282.1
7,637,076 B2 * 12/2009 Vaughn ..... E04C 3/32 403/217
7,827,738 B2 * 11/2010 Abrams ..... E04H 1/04 52/79.1
7,941,985 B2 * 5/2011 Simmons ..... E04B 1/24 52/655.1
8,011,156 B1 * 9/2011 Schwan ..... A63H 33/088 52/655.1
8,132,383 B1 * 3/2012 Herrmann ..... E04F 13/0736 52/489.1
8,316,621 B2 * 11/2012 Safari Kermanshahi ..... E04D 13/1625 52/234
8,468,775 B2 * 6/2013 Vaughn ..... E04C 3/32 52/843
9,347,213 B1 * 5/2016 Zhang ..... E04B 1/388
9,458,619 B2 10/2016 Bowron et al.
9,476,441 B2 10/2016 Strassle et al.
9,556,612 B2 * 1/2017 Bottin ..... E04B 5/023
11,230,838 B1 * 1/2022 Mendez-Vazquez ... E04B 1/388
2003/0041549 A1 * 3/2003 Simmons ..... E04B 1/2403 52/655.1
2004/0040222 A1 * 3/2004 Foss ..... B61D 17/14 52/41
2005/0210762 A1 * 9/2005 Broberg ..... E04C 3/32 52/79.9
2006/0150571 A1 * 7/2006 Zahner, III ..... E04C 3/06 52/838
2007/0137134 A1 * 6/2007 Plagemann ..... B29C 70/52 52/656.9
2007/0209314 A1 * 9/2007 Vaughn ..... E04B 1/24 52/838
2007/0227086 A1 * 10/2007 Beavers ..... E04B 1/80 52/309.7

(56) References Cited

U.S. PATENT DOCUMENTS

| | | | | |
|---|---|---|---|---|
| 2007/0261356 | A1* | 11/2007 | Vaughn | E02D 27/34 52/655.1 |
| 2007/0271857 | A1* | 11/2007 | Heather | B65D 88/022 52/79.9 |
| 2008/0050578 | A1* | 2/2008 | Sinclair, Sr. | H01M 4/32 428/318.4 |
| 2008/0282633 | A1* | 11/2008 | Buckholt | E04B 1/78 52/745.19 |
| 2011/0016801 | A1* | 1/2011 | Ziegelman | E04H 1/005 52/79.9 |
| 2012/0137612 | A1* | 6/2012 | Buckholt | E04C 3/292 29/897.3 |
| 2012/0216475 | A1* | 8/2012 | Safari Kermanshahi | E04C 3/086 52/309.4 |
| 2013/0055671 | A1* | 3/2013 | Bruce | E04C 3/08 52/645 |
| 2013/0118105 | A1* | 5/2013 | Efros | E04F 15/16 52/391 |
| 2013/0305629 | A1 | 11/2013 | Stephenson et al. | |
| 2014/0130441 | A1 | 5/2014 | Sugihara et al. | |
| 2014/0298745 | A1* | 10/2014 | Rechenmacher | E04H 1/005 52/425 |
| 2015/0007522 | A1 | 1/2015 | Dobija | |
| 2015/0159363 | A1* | 6/2015 | Ehsasi | E04H 1/1205 52/79.5 |
| 2016/0090741 | A1* | 3/2016 | Jobin | E04B 1/34326 52/646 |
| 2017/0002559 | A1 | 1/2017 | Bowron et al. | |
| 2017/0044753 | A1 | 2/2017 | Bowron | |
| 2018/0127967 | A1 | 5/2018 | Bowron | |
| 2018/0127982 | A1 | 5/2018 | Lemiegre et al. | |
| 2020/0199863 | A1 | 6/2020 | Binder | |
| 2023/0145105 | A1* | 5/2023 | Lai | E04B 5/29 52/506.01 |

FOREIGN PATENT DOCUMENTS

| | | |
|---|---|---|
| DE | 7536503 | 4/1976 |
| EP | 0267843 | 5/1988 |
| EP | 1055036 | 9/2002 |
| EP | 2674538 | 12/2013 |
| EP | 2685111 | 1/2014 |
| FR | 2042440 | 11/1970 |
| FR | 2379661 | 9/1978 |
| GB | 1088995 | 10/1967 |
| GB | 1350631 | 4/1974 |
| JP | H03-233042 | 10/1991 |
| JP | H05-025860 | 2/1993 |
| JP | H06-306954 | 11/1994 |
| JP | H07-158165 | 6/1995 |
| JP | H07-180228 | 7/1995 |
| JP | H11-081551 | 3/1999 |
| JP | 2000-045392 | 2/2000 |
| JP | 2000-240165 | 9/2000 |
| JP | 2001-081869 | 3/2001 |
| JP | 2005-097980 | 4/2005 |
| JP | 2005-314996 | 11/2005 |
| JP | 2016-513192 | 5/2016 |
| JP | 2017-515027 | 6/2017 |
| KR | 101320774 | 10/2013 |
| NL | 6906946 | 11/1970 |
| RU | 2120002 | 10/1998 |
| RU | 86634 | 9/2009 |
| RU | 180107 | 6/2018 |
| UA | 115776 | 12/2017 |
| WO | WO 00/09827 | 2/2000 |
| WO | WO 2005/111328 | 11/2005 |
| WO | WO 2009/073914 | 6/2009 |
| WO | WO 2010/086885 | 8/2010 |
| WO | WO 2013/177920 | 12/2013 |
| WO | WO 2015/164975 | 11/2015 |
| WO | WO 2016/141406 | 9/2016 |
| WO | WO 2016/176915 | 11/2016 |

OTHER PUBLICATIONS

Official Action for European Patent Application No. 17761184.5, dated Feb. 27, 2023, 5 pages.

Official Action (with English translation) for Korean Patent Application No. 10-2020-7007292, dated Dec. 26, 2022, 18 pages.

Written Opinion (English translation) for Singapore Patent Application No. 11202001183W, dated Dec. 12, 2022, 10 pages.

Search Report for Russian Patent Application No. 2020106401/03, dated Sep. 15. 2020, 3 pages.

Xie Chao et al. "Refusal-to-move analysis for 500KV AC circuit braker," Electro Engineering, Dec. 2012, pp. 9 and 28.

English Translation of Official Action for China Patent Application No. 201880053719.8, dated Jan. 12, 2021, 8 pages.

Notice of Allowance for U.S. Appl. No. 16/638,994, dated May 5, 2021, 15 pages.

International Search Report and Written Opinion for International (PCT) Patent Application No. PCT/EP2018/000392, dated Nov. 23, 2018, 11 pages.

International Preliminary Report on Patentability for International (PCT) Application No. PCT/EP2018/000392, dated Feb. 18, 2020, 8 pages.

Official Action for U.S. Appl. No. 16/638,994, dated Dec. 18, 2020, 16 pages.

International Preliminary Report on Patentability for International (PCT) Application No. PCT/EP2017/000997, dated Feb. 18, 2020, 8 pages.

International Search Report and Written Opinion for International (PCT) Patent Application No. PCT/EP2017/000997, dated May 7, 2018, 11 pages.

* cited by examiner

FRAME, BASIC FRAMEWORK, MODULE, PROFILE AND SET OF STRUCTURAL ELEMENTS FOR MODULAR CONSTRUCTION AND A MODULAR-CONSTRUCTION BUILDING

CROSS REFERENCE TO RELATED APPLICATIONS

This application is a national stage application under 35 U.S.C. 371 and claims the benefit of PCT Application No. PCT/EP2017/000997 having an international filing date of 18 Aug. 2017, which designated the United States, the disclosure of which is incorporated herein by reference in its entirety.

The invention relates to a frame, in particular a wall frame, which is intended for a preferably supporting, in preference self-supporting, basic framework of a module for modular construction and comprises two post profiles which can be, or are, arranged essentially vertically and of which the upper ends can be, or are, connected to one another via a ceiling profile and the lower ends can be, or are, connected to one another via a floor profile.

The invention also relates to a basic framework, to a module, to a profile and to a set of structural elements for modular construction and also to a modular-construction building.

Numerous proposals in respect of modular construction have been made over the decades.

In particular a frame of the type in question is known from EP 1 055 036 B1. A similar frame, has been disclosed by GB 1 350 631.

However, the known frames, and in particular the further development thereof to form cage-like building-block frameworks, still require a very high level of assembly outlay. Although the modular construction concept means that the respective construction site is largely spared this assembly outlay, the latter, rather than being reduced, is merely shifted to the industrial prefabrication stage. This applies, however, not just to the assembly outlay for the cage-like building-block frameworks, that is to say to the steel-construction work in the broadest sense, but also to the further development of these building-block frameworks to form finished-off zones having the requisite room walls, floors, laminates, insulation, windows, doors and, in particular, supply and disposal installations, for example for communications, power, heating, water, wastewater, other sanitary applications and so on.

The aim of modular construction should be to prefabricate, and finish off, room units, or areas of these units, as far as possible to form complete modules or module parts so that, on the construction site, all that is required is for these room units to be assembled-to form buildings, to be precise with a reasonable balance of standardization and individual design. At the same time, this forms a principle on which a general problem of the present invention is based.

In specific terms, the invention is based on the problem of further developing structural elements, structural units and/or modules for modular construction such that it is possible, using the smallest possible number of novel, appropriately designed structural elements, and preferably, if need be, in addition structural elements which are common from drywall construction, to produce and prefabricate, with a relatively low level of assembly outlay, finished-off room units, or areas for said units, which can be combined, preferably with a supporting function, to form complete buildings, even relatively high buildings for, for example, urban centres.

This problem is solved according to the invention in an advantageous and surprising manner in respect of a frame according to the invention, by a post profile, a ceiling profile and a floor profile each having differently configured cross-sectional profiles.

According to the invention a frame preferably from four basic structural elements, that is to say from two post profiles, a ceiling profile and a floor profile is provided. These four structural elements are of only three different structural shapes and therefore preferably form basic elements of a kind of modular-construction system. The three structural shapes are designed optimally in accordance with their respective purpose and, at the same time, have certain key shapes which provide for a largely standardized connection and combination with other structural elements from the modular-construction system. On a higher system level, for a basic framework, the frame according to the invention produced accordingly itself, in turn, becomes a basic structural element. The resulting basic framework according to the invention is, on an even higher system level, a basic structural unit for a module.

The frame according to the invention is an important basic element in so far as the frame already predetermines, and ensures, the supporting capability and the self-supporting capability of the basic framework and of the module. This inventive achievement will be explained in yet more detail, and will be clarified, hereinbelow along with the respective embodiments of the invention. It is already anticipated, however, that the frame according to the invention advantageously allows for closing to form a complete room wall and to be finished off and/or for a design decision to be freely made at a later stage, albeit still within the industrial-manufacturing phase rather than on the construction site. The decision which side surfaces of the subsequent basic framework should be closed and/or filled is without relevance to the supporting capability of the module and of the framework. This also ultimately provides for the design freedom for room units or areas, in particular walls and/or ceiling and/or floor, provided by a basic framework or module to be formed into an enclosed room, or parts thereof, or to be connected to other basic frameworks or modules via still-open side surfaces to form larger rooms. It should be emphasized once again that it is preferably and highly advantageously made possible according to the invention for complete room sections to be industrially manufactured and provided with all surfaces, elements and installations of a complete building area, and all that is required is for these to be fitted, and connected, on the construction site. In particular the drywall work and installation work can thus advantageously be shifted from the construction site to the industrial-manufacturing phase.

It should also be pointed out that it is also possible for closed or filled side surfaces to have (delimited) openings, for example for windows, doors or staircases.

The three different profile shapes of the frame according to the invention can advantageously be designed in accordance with their purpose, that is to say in preparation for configuring a module ceiling, a module floor or a module wall. The different structural shapes also render these profiles distinct, which considerably simplifies, and speeds up, the assembly of a frame, even for untrained personnel. At the same time, the profiles can be configured so as to have the necessary strength and supporting capability. In addition, as already mentioned, use can be made of "key shapes" in the design of the profiles, and these key shapes could be standardized as interfaces for connection to other structural elements. The possible material to use here is, in particular, steel, preferably lightweight steel.

A further advantage of the invention is also that dismantling of a frame according to the invention, and therefore also of an entire module, is just as easy as the assembly thereof.

An embodiment of the frame according to the invention provides for each of the cross-sectional profiles to be designed essentially, or in certain regions, in the form of a hollow profile. For this purpose, a profile can be formed preferably by virtue of a metal sheet being subjected to a forming operation. The metal sheet may advantageously be cold-rolled.

A hollow profile can be realized with lower weight, less material and therefore also fewer resources, and in a more ecological and cost-effective manner, and nevertheless, in particular as a result of its cross-sectional shaping, can provide adequate and appropriate stability and supporting capability and also functionality. Manufacturing from a metal sheet is particularly expedient for this purpose and it is possible to make use of conventional forming techniques, in particular folding, bending and/or rolling. By virtue of bending or folding radii being predetermined, it is possible to ensure that there is no undesired weakening in material or workpieces. For reasons relating to stability and/or manufacture, provision may be made for not all regions to be of hollow design. However, it is also possible, during manufacture from the metal sheet, to work, for example, with multi-layered regions as well. The metal-sheet thickness for example of a steel sheet used could be, for example, preferably 3 to 5 mm, preferably approximately 4 mm.

Hollow regions in the profiles can be used as channels for supply lines, although such lines can also be accommodated in the usual manner, as for drywall construction, in compartments, other profiles, shafts, channels or the like.

In the first instance the advantageous embodiment of the different cross-sectional profiles according to the invention will now be considered, and explained, in detail hereinbelow.

An embodiment of the invention is characterized by the post profile being designed in the form of a corner profile to allow for connection of two ceiling profiles and/or floor profiles. The profiles are preferably connected essentially at angles to one another, especially preferably at right angles to one another. The angle is bigger than 10°, preferably bigger than 20° and smaller than 180°.

The post profile according to the invention thus advantageously ensures, and provides for, a precise corner design for the basic framework. At the same time, it can perform its important supporting-capability task for the entire structure as a corner column of a frame and of a basic framework made therefrom. It is therefore in particular also the the corner profile that provides the basis for all the structural elements to be constructed in a dimensionally accurate manner with the correct angles and the corner profile thus also has a positive effect on the assembly outlay along with simultaneously reliable quality and reproducibility.

An embodiment of the invention provides for the post profile to have at least one slot guide which extends at least over a portion of the longitudinal direction of the post profile and into which at least one connecting element for the connection of a ceiling profile and/or floor profile is inserted and retained. The slot guide provides a defined and reliable interface for the attachment of the other cross-sectional profiles, and this interface preferably also ensures the correct orientation of said other cross-sectional profiles, since preferably each assembly operation can proceed with orientation taking place with abutment. It is preferably possible, in the case of an embodiment of the post profile according to the invention, for the at least one slot guide also to be incorporated in the cross-sectional profile of the post profile.

To design the post profile according to the invention in the form of a corner support, provision is preferably made for the cross-sectional profile of the post profile to have at least two slot guides with opening directions oriented at an angle, preferably essentially at right angles, to one another. As already explained, the orientation of the opening direction preferably also ensures the correct orientation of the other profiles which are to be mounted thereon.

A preferred and particularly advantageous embodiment of the post profile according to the invention and of the frame according to the invention provides for the cross-sectional profile of the post profile, at least in a cross-section plane, to have essentially the contour of a rectangle, preferably essentially of a square, with concavities present in two of its adjacent side-surface contours forming the cross sections of the respective slot guides. This simultaneously ensures the stability and supporting capability of the post profile and of the frame, the corner formation of the frame and of the resulting basic framework and the correct and reliable attachment of the other profiles. It also allows for the post profile being manufactured in a relatively quick, straightforward and cost-effective manner.

A preferred post-profile design, in which the cross section of the slot guide is of approximately dovetail shape, predominantly provides for easier and smoother insertion of a connecting element into said slot guide by providing a kind of insertion funnel or insertion cone. The funnel does not adversely affect the final correct orientation of the connection, which can be ensured by other elements or features. For example it is possible for both the correct orientation and reliable fastening to be achieved by preparing the slot guide such that the connecting element can be fastened in a form-fitting manner, in particular can be hooked in. For example it would be possible for the slot guide to have, in its base region, insertion slots, into which hook elements of connecting elements could be inserted and then hooked in from above by way of downward movement. The, preferably each, connecting element could be designed essentially straightforwardly in the form of a connecting plate which can be arranged essentially vertically.

Another embodiment of the invention is characterized by the ceiling profile and the floor profile each having essentially a double-T-shaped cross-sectional profile, of which the crosspiece is provided for essentially vertical arrangement. The transverse extremities which are present at the top and bottom of the crosspiece forming the double-T shape, are designed in the form of a thickened head portion and/or thickened foot portion. The thickened foot portion in the cross-sectional profile of the floor profile preferably has a greater vertical extent than the vertical extent of the thickened foot of the ceiling profile.

According to the invention, the ceiling profile and the floor profile are therefore preferably, in part, of a similar structural shape, in particular in their central crosspiece region, and this promotes interoperability. On the other hand, however, they are also of structural shapes which differ from one another in accordance with their purpose. They both preferably have thickened head portions and thickened foot portions, as a result of which it is, in particular, possible to predetermine, and set, the stability and supporting capability of the respective profile. Taking account of their different purposes, preferably the thickened foot portion of the floor profile is of greater dimensions than that of the ceiling profile, as a result of which, in particular in the region of the ceiling, weight is reduced and, in the region of the floor, the supporting capability is increased. The supporting capability can be increased in addition by virtue of the ceiling profile and the floor profile being connected, during assembly, to form supports which are located one above the other.

In particular it is possible for a embodiment to provide for the thickened head portion and the thickened foot portion of the floor profile to be of approximately equal size, preferably with the thickened foot portion being designed to be somewhat more extensive.

An embodiment of the ceiling profile preferably provides for the thickened head portion of the ceiling profile to be designed to be larger than the thickened foot portion of said profile.

It is advantageous for the shaping of the basic framework and of the module if the thickened head portion and/or the thickened foot portion are essentially box-shaped in cross section. This can simplify the manufacturing of the profiles and ensure the stability and supporting capability of the profiles.

It has already been mentioned that, for interoperability, the ceiling profile and the floor profile may have similar regions, in particular in the crosspiece region. An embodiment of the invention provides for the height of the crosspiece and/or the distance between the outer surface of the thickened head portion and the outer surface of the thickened foot portion to be available as a space for a preferably insulated drywall construction having at least one layer of panelling, or part thereof, on at least one side. Provision may preferably be made for the free space which is bounded by the thickened head portion, the thickened foot portion and the crosspiece, and is essentially U-shaped in cross-sectional profile, to be provided in the form of a mount in order for at least one drywall-construction profile to be inserted in a form-fitting manner approximately orthogonally in relation to the crosspiece.

In particular in this region it is thus preferably possible to create and provide an interface (preferably standardized) for, if need be, additional structural elements which are common from drywall construction, as has already been mentioned above in conjunction with the problem of the invention. Rather than using profiles from conventional, non-supporting drywall construction, use would preferably be made here of profiles from lightweight-steel construction, wherein it is basically immaterial whether the lightweight-steel construction is considered as being a special kind of drywall construction or a separate kind of construction. In the present context, for the sake of simplicity, the lightweight-steel construction is considered to be a special kind of the drywall construction since within the context of the invention, depending on requirements, use could be made of non-supporting or supporting elements.

It is however possible for drywall-construction profiles in the broadest sense mentioned, preferably C profiles, to be inserted in a form-fitting manner in the mounts formed in the ceiling profiles and in the floor profiles according to the invention. It is also possible for the panelling, or any other lamination or covering, of said drywall-construction profiles, to use an outer surface of the respective profile, in particular if a multi-layered construction of a ceiling or of a floor is envisaged.

It is preferably possible that the ceiling profile according to the invention and also the floor profile according to the invention, having a crosspiece height of approximately 100 mm, or at least appropriate for a correspondingly dimensioned C profile. Since, depending on requirements or application, very differently dimensioned drywall-construction profiles can be useful, in particular taking into account different national customs or standards, it would be possible to vary such a dimension appropriately for different embodiments of frames and profiles according to the invention, on the one hand for example by ±3 mm, as a variation in dimension rather than as a manufacturing tolerance. On the other hand dimensions can also vary by orders of magnitude such as, for example, approximately 150, 200 or 250 mm.

For a ceiling profile, for example the thickened head portion could have a height of approximately 30 to 42 mm, preferably of approximately 36 mm. The thickened foot portion could have, for example, a height of approximately 10 to 18 mm, preferably approximately 14 mm.

In the case of the floor profile, for example the thickened head portion could have a height of approximately 40 to 56 mm, preferably of approximately 48 mm. The thickened foot portion 5. could have, for example, a height of approximately 40 to 64 mm, preferably approximately 52 mm.

The width for the two profiles could be, for example, in the range from approximately 60 to 80 mm, and could be preferably approximately 70 mm.

Independent protection is also sought for a basic framework according to the invention which belongs to a module for a modular construction and, in an independent solution to the stated problem, is characterized in that the framework comprises two frames, wherein the respective post profiles are designed in the form of corner profiles and wherein the two frames are arranged parallel to one another, and wherein the corner profiles of a first frame are connected to the corner profiles of a second frame via a ceiling profiles and floor profiles, respectively.

In other words, a basic framwork comprises two frames according to the invention, in which the respective post profiles are designed in the form of corner profiles according to the invention. The two frames are arranged parallel to one another and in alignment (congruently) with one another, and, for the purpose of connecting the two frames, those corner profiles of the two frames being located opposite one another are connected to one another via a respective ceiling profile and a respective floor profile.

It is therefore preferably in accordance with the same principle, on a higher system level, that frames according to the invention are advantageously used to form a stable basic framework which, for its part, forms the skeleton of a building block or a room unit of a module. Attention is drawn to the fact that two frames are connected via corner, posts with the same ceiling profiles and floor profiles as the frames themselves, although they can differ in length, essentially to form a cuboidal framework. It is then no longer possible to make out the original frames and the connecting profiles in said basic framework since, following connection, all four wall surfaces ultimately present themselves as, similar frames. The assembly of a plurality of such frameworks can further contribute to architectural variety and development possibility, since the orientation of the basic framework is not a decisive factor for stability and supporting capability.

In particular it is possible, according to an embodiment of the basic framework according to the invention, for any desired side-length ratios and cuboidal shapes to be achieved (with the static requirements being taken into consideration) by for example the ceiling profiles and floor profiles which are used to build the frames being of a different length from the ceiling profiles and floor profiles which are used for connecting the frames to one another. This means that once the two frames have been connected it is no longer possible to make out the original frames as such.

As has already been mentioned above, an embodiment may be characterized by realizing different effective lengths of ceiling profiles and/or floor profiles by longitudinal connection of at least two ceiling-profile portions and/or floor-profile portions.

Since the basic framework, as already explained, forms the skeleton for a building block or room unit, provision may advantageously be made for at least two basic frameworks, constituting building blocks, to be capable of being connected to one another one above the other, one beside the other and/or one behind the other in order to realise a basic framework for a building having at least two rooms or having at least one relatively large room made of more than one basic framwork. In particular it is also possible for the basic frameworks to be connected to one another in a stable and supporting manner not just on the same level, but also in a stack having different levels. It is advantageously possible for the upper basic framework/module to provide a complete floor and for the lower basic framework/module to provide a ceiling there beneath. The basic frameworks can be connected to one another by specific connecting elements or also by relatively straightforward connecting plates. Preferably connecting pieces for a key/lock connection are used. It would thus be possible, for example for a stacking arrangement, for a connecting piece to have form-fitting bodies in the upward and downward directions, it being possible for said form-fitting bodies to be introduced in a form-fitting manner, and latched, in corresponding mounts, for example in the upper and lower end surfaces of the corner profiles, and possibly to be turned by an externally attached tool, for example a kind of handspike.

Independent protection is likewise claimed for a module according to the invention which is intended for modular construction and, in an independent solution to the stated problem, is characterized by at least one frame according to the invention and/or by at least one basic framework according to the invention.

An embodiment of the module according to the invention is preferably characterized by at least one drywall construction for closing and/or for filling at least one of the surfaces defined by the frame and/or the basic framework. As already explained, in principle common structural elements can be used for this purpose. Which surfaces are filled and which remain open depends on the desired combination of the respective module with neighbouring modules to form spaces. As already mentioned above, it is also possible to include requisite supply and disposal installations, as provided for by a preferred embodiment of the invention.

As likewise already mentioned and explained above, it is possible to provide preferably at least one drywall-construction profile for closing and/or for filling at least one of the surfaces defined by a frame and/or basic framework, wherein provision may preferably be made for the at least one drywall-construction profile to have its respective ends inserted, and mounted, in a form-fitting manner, essentially orthogonally in relation to two mutually opposite, essentially parallel ceiling profiles or floor profiles, in mounts which are approximately U-shaped in cross-sectional profile and belong to said ceiling profiles or floor profiles. The at least one drywall-construction profile may preferably have at least one layer of panelling on at least one side.

A preferred embodiment of the module according to the invention provides for at least the ceiling surface, floor surface and at least one of the four side surfaces defined by the basic framework to be closed and/or filled, wherein the respectively open side surfaces can serve for the connection of other room units to form a corresponding room. In particular it is therefore also possible to have tunnel-like modules, which can be used as lengthening intermediaries between two other modules. It is also possible, however, for adjacent side surfaces to remain open and, for example together with three similar modules, to form a room of four times the size. Of course, it is nevertheless also possible for all the side surfaces to be closed in order to form an enclosed room or to remain open, in the latter case for example for a module which can be arranged centrally to provide for a very large room or hall.

As already mentioned, another embodiment of the module according to the invention may preferably be characterized by the module being provided, and finished off, with installations which are necessary in a certain region of a room of a building.

As already described in conjunction with the basic framework according to the invention, it is correspondingly possible for preferably at least two modules, constituting zones, to be capable of being connected to one another one above the other, one beside the other and/or one behind the other in order to realise a building having at least two rooms and/or having at least one relatively large room.

Independent protection is also claimed for a modular-construction building according to the invention which, in an independent solution to the stated problem, is characterized by at least one frame according to the invention and/or by at least one basic framework according to the invention and/or by a module according to the invention.

Additionally, independent protection is claimed for a profile according to the invention which, in an independent solution to the stated problem, is characterized by being designed in the form of a post profile which can be arranged essentially vertically, preferably for a basic framework according to the invention and/or for a module according to the invention.

Preferred embodiments of such a post profile according to the invention have already been explained above, and, in order to avoid unnecessary repetition, reference is made to the explanation above.

Further, independent protection is claimed for a profile according to the invention which, in an independent solution to the stated problem, is characterized by being designed in the form of a profile which can be arranged essentially horizontally and is intended for connecting two post profiles, preferably post profiles according to the invention, to one another, preferably for a basic framework according to the invention and/or for a module according to the invention.

Preferred embodiments of a ceiling profile and/or floor profile according to the invention have likewise been explained above, and therefore, in order to avoid unnecessary repetition in this respect as well, reference is made to the explanation above.

Independent protection is claimed for a set of structural elements according to the invention which is intended for a preferably supporting, in preference self-supporting, basic framework of a module for modular construction and comprises two post profiles which can be, or are, arranged essentially vertically and of which the upper ends can be, or are, connected to one another via a ceiling profile and the lower ends can be, or are, connected to one another via a floor profile. Said set of structural elements, in an independent solution to the stated problem, is characterized by at least one profile according to the invention and/or at least one frame according to the invention.

As already explained above, it is an advantage according to the invention that it is possible to provide a modular-construction system which has a relatively small number of straightforward construction elements and can be used to provide, in particular, basic frameworks for a versatile, reliable and stable and supporting module for modular construction. This can also be realized in practice in particular in the form of a set of structural elements according to the invention.

According to another embodiment, the set of structural elements according to the invention is characterized by at least one connecting element by means of which a ceiling profile and/or a floor profile which can be arranged approximately horizontally can be connected to a post profile being arranged essentially vertically. The at least one connecting element can be designed preferably in the form of a for the most part flat connecting plate which can be arranged preferably approximately vertically.

According to a preferred embodiment, the at least one connecting element has at least one fastening element for establishing a hook-in connection with the post profile.

Exemplary embodiments from which further inventive features can be gathered, but which are to be considered basically as being given merely by way of example and should not restrict the subject matter of the invention or the scope of protection thereof, are illustrated in the drawing, in which:

FIG. 1 shows a side view of a frame 1 according to the invention for modular construction.

The frame 1 according to the invention comprises two vertical post profiles 2, a horizontal ceiling profile 3, which connects the upper ends of the post profiles 2 to one another, and a horizontal floor profile 4, which connects the lower ends of the post profiles 2 to one another.

The frame 1 can form essentially the frame for a wall of a module for a modular construction. At the same time, it can serve as a component for constructing an essentially approximately cuboidal basic framework for such a module, wherein the ceiling profile 3 then forms part of the ceiling of the module and the floor profile 4 forms part of the floor of the module.

Figure 1:
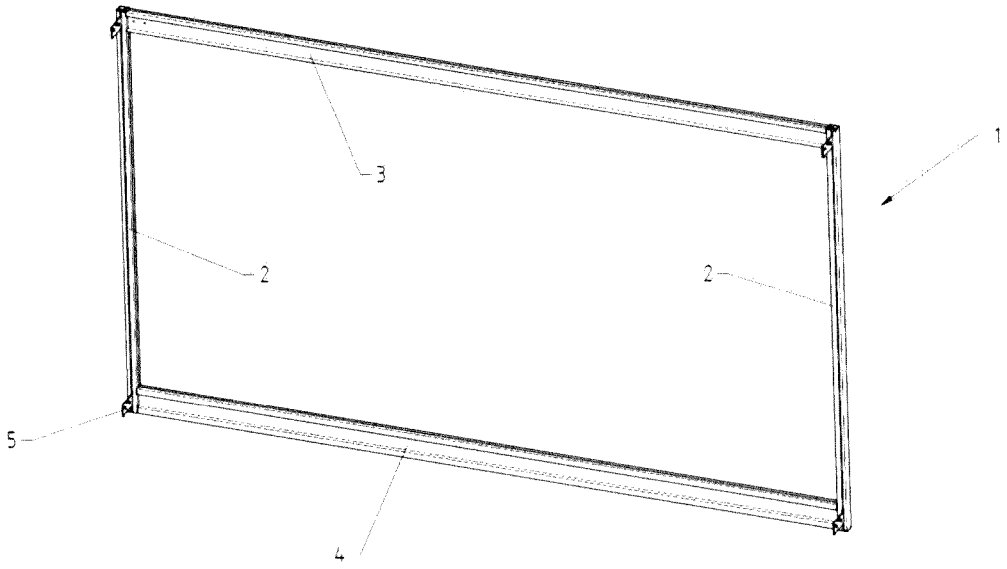
FIG. 1 shows a side view of a frame according to the invention for modular construction.

The post profiles 2 are designed in the form of corner profiles such that ceiling profiles 3 and floor profiles 4 oriented orthogonally with respect to the floor profile 4 and to the ceiling profile 3 shown in FIG. 1, can be attached in order to form other walls of the module.

The ceiling profiles 3 and floor profiles 4 are connected to the post profiles 2 via essentially plate-like, flat connecting elements 5.

Figure 2A:
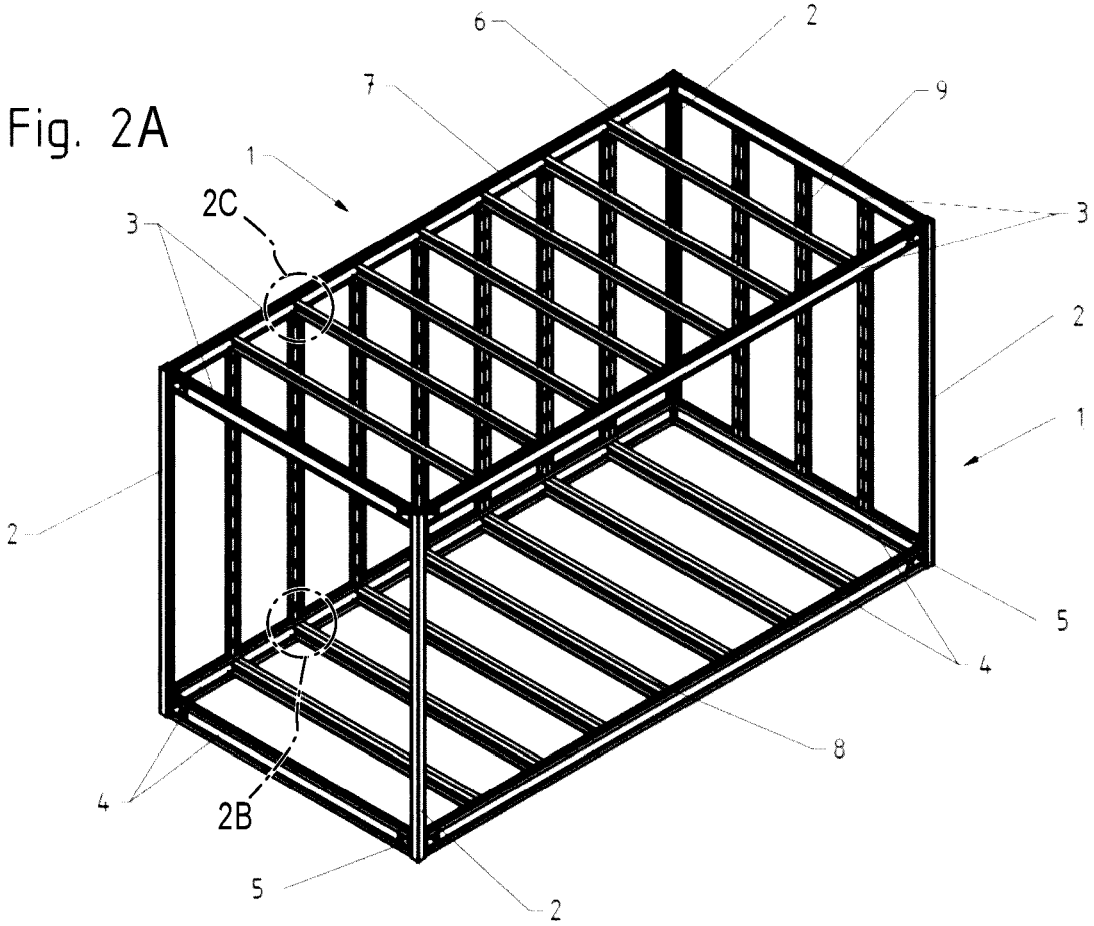
FIG. 2A shows a perspective view of a basic framework according to the invention, comprising two frames according to FIG. 1.

FIG. 2 shows a perspective view of a basic framework according to the invention for a module for modular construction.

Two frames 1 form the longitudinal-side wall frames of this basic framework. As already explained in conjunction with FIG. 1, the respective post profiles 2 of these frames 1 are connected to one another transversely via further ceiling profiles 3 and floor profiles 4, to form a cuboidal shape. It is however also possible to connect the narrow sides of the, framework to one another longitudinally via ceiling profiles 3 and floor profiles 4, since both the narrow sides and the longitudinal sides represent frames 1 according to the invention. This renders the basic framework particularly stable from the point of view of statics and also gives it a supporting capability, overall also a self-supporting capability. It is thus possible, in particular, for a large number of such basic frameworks to be stacked one upon the other, and connected to one another, to form storeys of buildings, this therefore providing for truly modular construction. This is also possible even when, as shown in FIG. 2, for example one frame 1 is open, that is to say remains unfilled even in the module, and therefore it is possible for a basic framework which is open in a correspondingly mirror-inverted manner to be attached to this open side creating a continuous space which is double the size of a room unit formed by a single basic framework. It is possible for two or more side walls to be left open, in order to form even larger spaces using a plurality of basic frameworks. This is possible because frame 1 as shown in FIG. 1, whether or not completed to form a wall, always establishes the desired stability and supporting capability. This is preferably achieved by the particular shape of the cross-sectional profile of the respective profiles 2, 3, 4, which will be discussed in yet more detail hereinbelow.

As can be seen in FIG. 2, the connecting elements 5 butt against the respective profiles 3, 4 from the outside.

To provide further construction elements for drywall constructions, drywall-construction profiles 6, 7, 8, 9, for example C profiles, in particular lightweight-steel drywall-construction profiles, can be inserted between the frame profiles 2, 3, 4. The frame profiles 2, 3, 4 are manufactured preferably from sheet steel.

Figure 3:
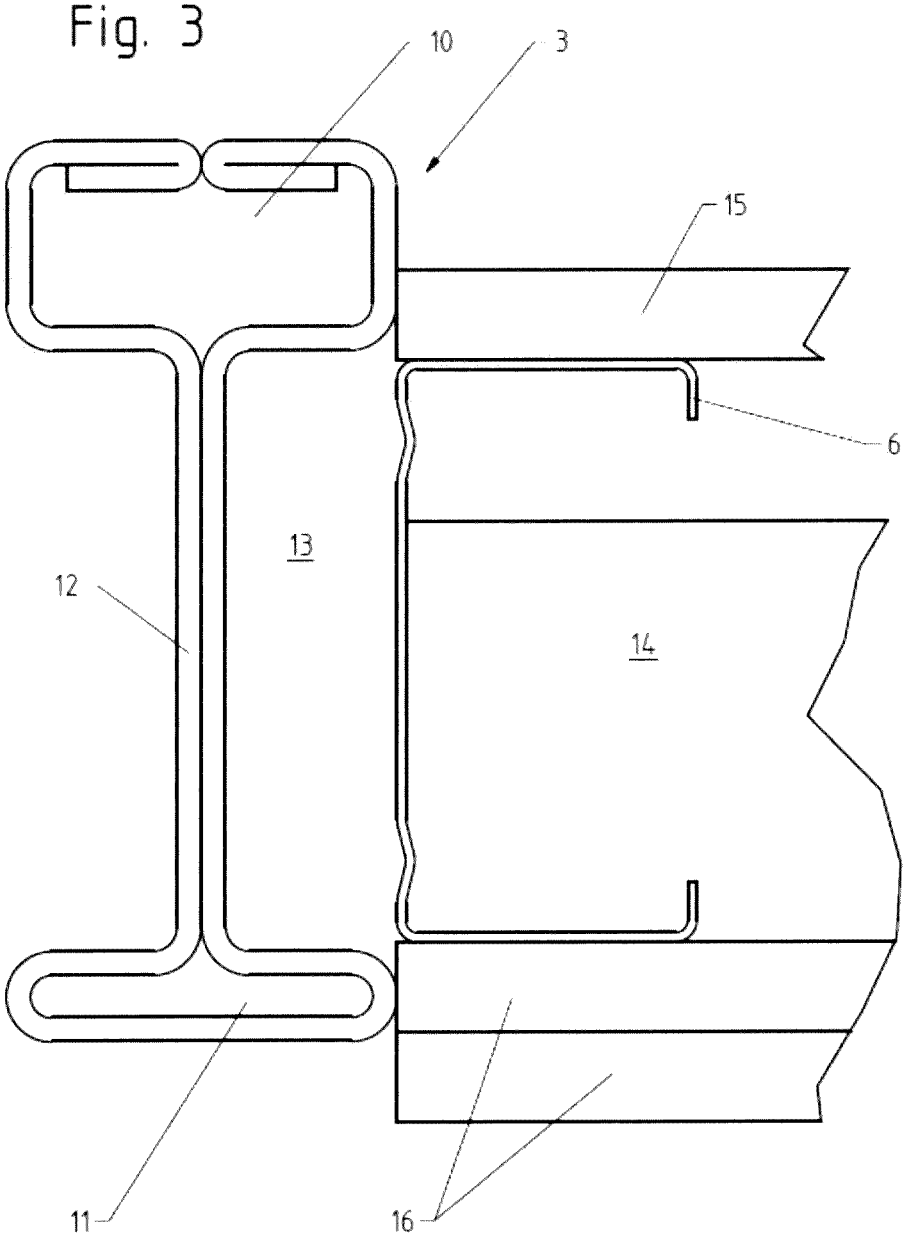
FIG. 3 shows a cross section of a ceiling profile for a frame according to FIG. 1.

FIG. 3 shows a cross section of a ceiling profile 3 according to the invention for a frame 1 according to FIG. 1.

It can be seen that the ceiling profile 3 is formed from a sheet-form material, preferably from a metal sheet, preferably from a steel sheet. Cross-sectionally hollow profile regions have been formed. The metal sheet has been bent or angled in round form by way of corner radii so as to avoid material weakenings in the corner regions.

Additional weld connections for the purpose of further enhancing the stability of the profile are conceivable and possible in some regions, in particular in the seam region of the respective profile.

The ceiling profile 3 is essentially formed into a double-T cross-sectional shape. A hollow thickened head portion 10 and a hollow thickened foot portion 11 are formed. The crosspiece 12 of the ceiling profile 3, said crosspiece being oriented vertically in the frame 1, extends between the thickened head portion 10 and thickened foot portion 11.

Alongside and/or at the ceiling profile 3, FIG. 3 indicates drywall-construction elements for forming a ceiling for completing a module and for filling the ceiling surface of a basic framework according to FIG. 2.

Figure 2B:
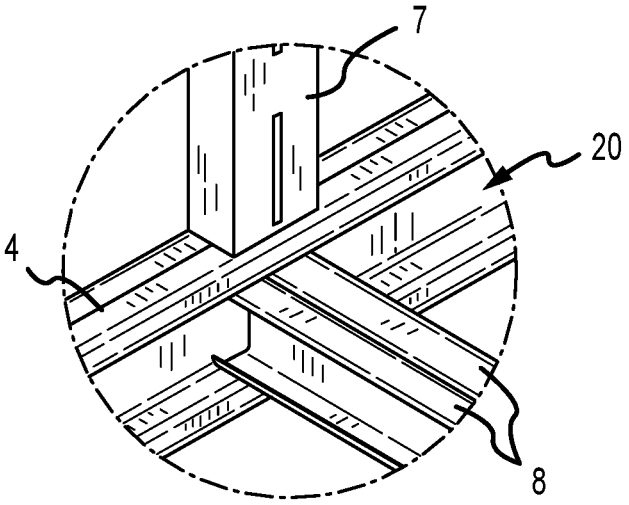
FIG. 2B shows an enlarged perspective view of a connection between a floor profile and a C-shaped profile illustrated in FIG. 2A.
Figure 2C:
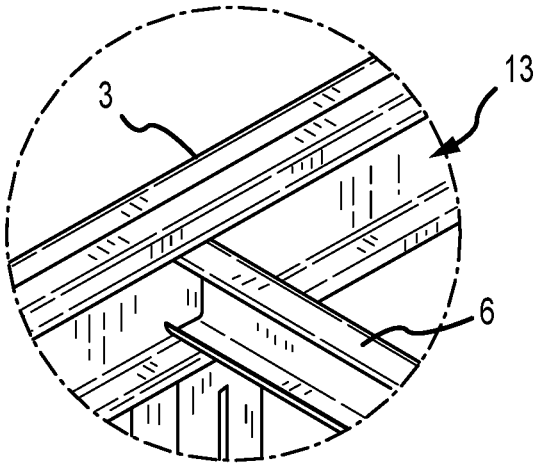
FIG. 2C shows an enlarged perspective view of a connection between a ceiling profile and a C-shaped profile illustrated in FIG. 2A.

The figure shows the approximately C-shaped cross section of a drywall-construction profile 6, in particular of a lightweight-steel-construction profile, a number of which can also be seen in FIG. 2. As illustrated in FIG. 2C, the end sides of such a profile 6 can be inserted in a form-fitting manner into the cross-sectionally approximately U-shaped mounts 13 which are formed by the thickened head portions 10, the thickened foot portions 11 and the crosspieces 12 of ceiling profiles 3 (orthogonally oriented to the one shown in FIG. 3), said insertion operation taking place up to the crosspieces 12.

FIG. 3 indicates an insulating-material layer 14, for example made of mineral wool, in the profile 6. In addition, the profile 6 is panelled on both sides with panelling boards 15, 16, for example gypsum boards. The upper panelling 15 is in one layer; the lower panelling 16, which forms the ceiling surface which is visible in the room formed by a module, is double-layered. The insulating material 14, the profile 6 and the panellings 15 and 16, and possibly other structural elements, can also provide for sound insulation and/or fire protection.

Figure 4:
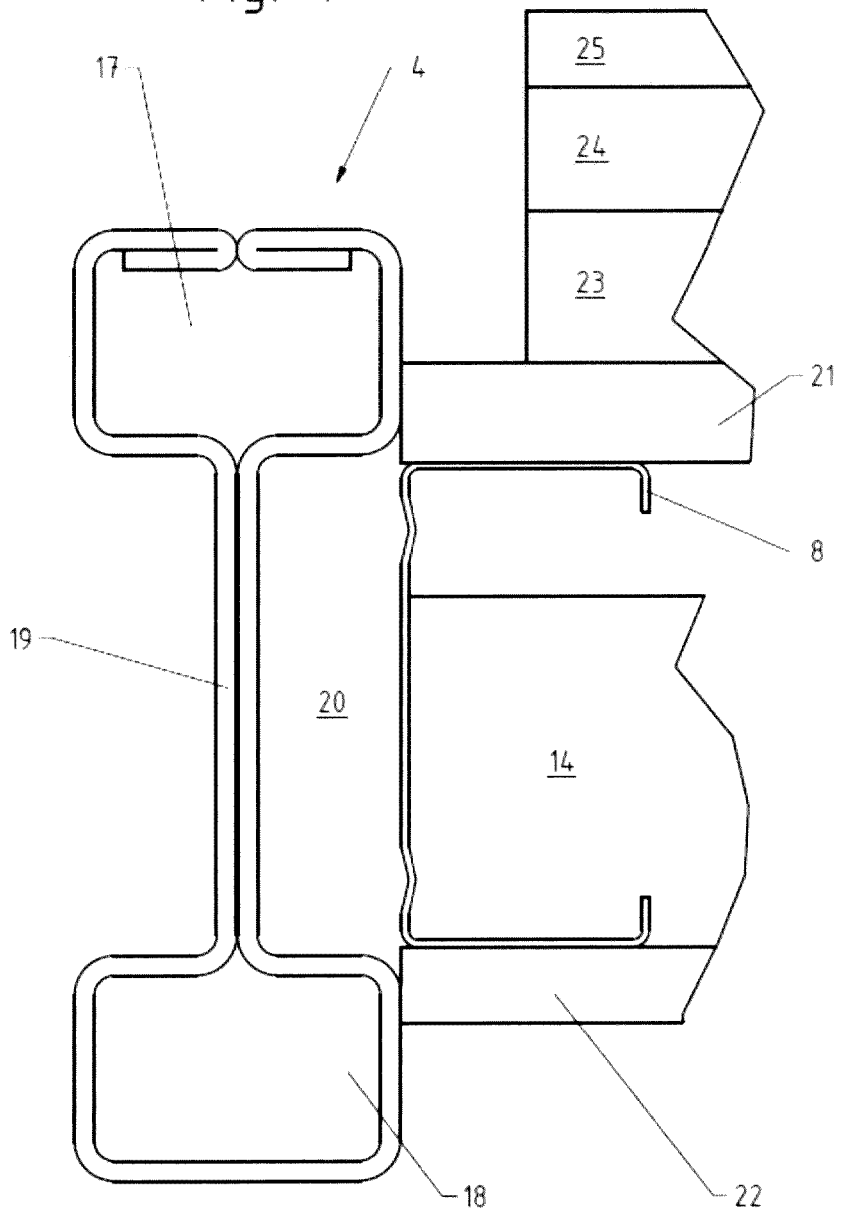
FIG. 4 shows a cross section of a floor profile for a frame according to FIG. 1.

FIG. 4 shows a cross section of a floor profile 4 according to the invention for a frame 1 according to FIG. 1.

It can be seen that the floor profile 4 is formed from a sheet-form material, preferably from a metal sheet, preferably from a steel sheet. Cross-sectionally hollow profile regions have been formed. The metal sheet has been bent or angled in round form by way of corner radii so as to avoid material weakenings in the corner regions.

Additional weld connections for the purpose of further enhancing the stability of the profile are conceivable and possible in some regions, in particular in the seam region of the respective profile.

The floor profile 4 is essentially formed into a double-T cross-sectional shape. A hollow thickened head portion 17 and a hollow thickened foot portion 18 are formed here. The crosspiece 19 of the floor profile 4, said crosspiece being oriented vertically in the frame 1, extends between the thickened head portion 17 and thickened floor portion 18.

Alongside and/or at the floor profile 4, FIG. 4 indicates drywall-construction elements for forming a floor for completing a module and for filling the floor surface of a basic framework according to FIG. 2.

The figure shows the essentially C-shaped cross section of a drywall-construction profile 8, in particular of a lightweight-steel-construction profile, a number of which can also be seen in FIG. 2. As illustrated in FIG. 2B, the end sides of such a profile 8 can be inserted in a form-fitting manner into the cross-sectionally approximately U-shaped mounts 20 which are formed by the thickened head portions 17, the thickened foot portions 18 and the crosspieces 19 of floor profiles 4 (orthogonally oriented to the one shown in FIG. 4), said insertion operation taking place up to the crosspieces 19.

FIG. 4 indicates an insulating-material layer 14, for example made of mineral wool, in the profile 8. In addition, the profile 8 is panelled on both sides with panelling boards 21, 22, for example gypsum boards and/or woodbased-material boards or any other suitable building boards known by the artisan. The two panellings 21, 22 are formed in one layer. In addition, in the exemplary embodiment shown in FIG. 4, the floor has three further layers 23, 24, 25, of which the uppermost layer 25 forms the-floor surface which is visible in the room formed by a module. The insulating material 14, the profile 8, the panellings 21, 22 and the layers 23, 24, 25, and possibly other structural elements, can also provide for sound insulation and/or fire protection.

Side walls of a module may be formed and panelled, for example, in a similar manner to a ceiling according to FIG. 3.

Figure 5:
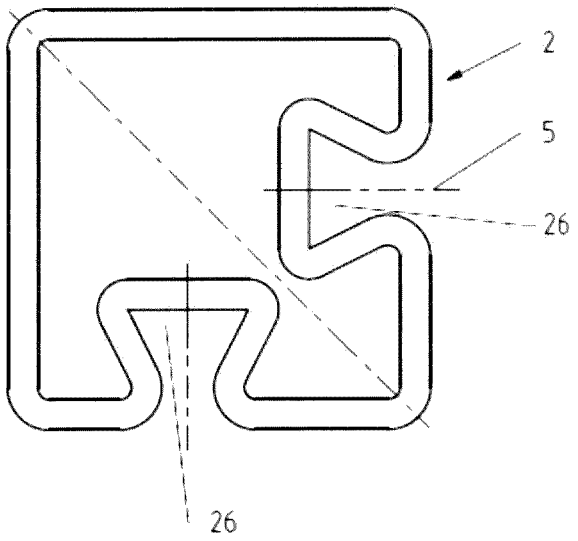
FIG. 5 shows a cross section of a post profile for a frame according to FIG. 1.

FIG. 5 shows a cross section of a post profile 2 according to the invention which is designed in the form of a corner profile and is intended for a frame 1 according to FIG. 1.

It can be seen that the post profile 2 is formed from a sheet-form material, preferably from a metal sheet, preferably from a steel sheet. Cross-sectionally hollow profile regions have been formed. The metal sheet has been bent or angled in round form by way of corner radii so as to avoid material weakenings in the corner regions.

Additional weld connections for the purpose of further enhancing the stability of the profile are conceivable and possible in some regions, in particular in the seam region of the respective profile.

The cross section of the post profile 2 shown in FIG. 5 by way of example is approximately square.

Slot guides 26 which, for reasons relating to stability, are of approximately dovetail shape in cross section are incorporated in two of the outer surfaces of the post profile. As indicated in FIG. 5, the slot guides 26 serve for connecting elements 5 to be introduced and fixed therein, the connecting elements thus being oriented orthogonally in relation to one another to form a corner.

Figure 6:
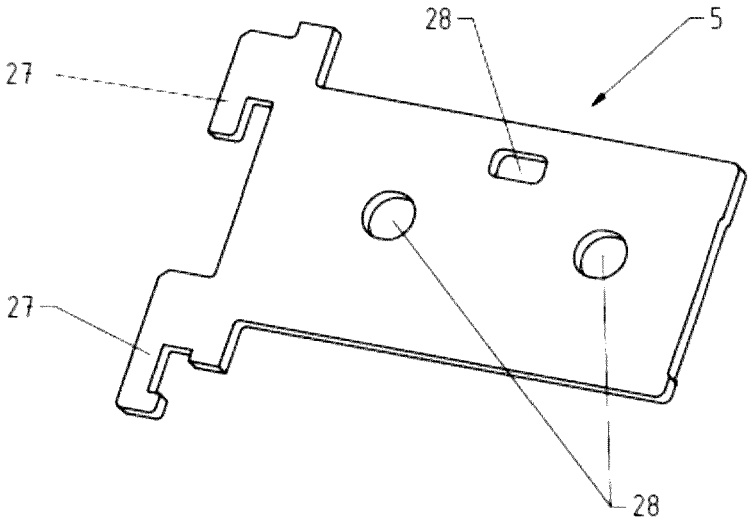
FIG. 6 shows a perspective view of a connecting element for use in a post profile according to FIG. 5.

FIG. 6 shows a perspective view of a connecting element for use in a post profile 2 according to FIG. 5.

The connecting element 5 is designed in the form of a flat connecting plate and, at one end; has hooks 27 which can be hooked into slots in the base of a slot guide 26 of a post profile 2 (not illustrated). The connecting element 5 additionally has fastening holes 28, through which screws or similar fastening means can be guided in order to connect the connecting element 5 to crosspieces 12 or 19 of ceiling, profiles 3 or floor profiles 4, respectively.

The profiles 2, 3, 4 illustrated in the drawings form, along with the connecting element 5, an easy-to-handle set of structural elements or a modular-construction system which provides for the quick, straightforward, precise and, in particular, also stable construction of basic frameworks which have a supporting function, and can be combined with one another in order to form modules for modular construction.

The invention claimed is:

1. A frame for constructing at least one module, comprising two vertical post profiles each having an upper end and a lower end, a ceiling profile and a floor profile, wherein the upper ends of the post profiles are connected to one another via the ceiling profile and the lower ends are connected to one another via the floor profile, and wherein the post profiles have a first cross-sectional shape, the ceiling profile has a second cross-sectional shape with a head portion spaced from a foot portion with an interconnecting crosspiece, the floor profile has a third cross-sectional shape with a head portion spaced from a foot portion with an interconnecting piece, and wherein the cross-sectional shape of the foot portions of the ceiling and floor profiles are different and the third cross-sectional shape is different from the first and second cross-sectional shapes.

2. The frame according to claim 1, wherein the head portion and foot portion of the ceiling and floor profiles are hollow.

3. The frame according to claim 1, wherein each of the two post profiles comprises an elongate member having a plurality of outer walls defining an interior space, and at least one slot guide which extends at least over a portion of an outer wall and into the interior space, and further comprising a connecting element disposed within the at least one slot guide and connecting either a ceiling profile or a floor profile to a post profile.

4. The frame according to claim 1, wherein the two vertical post profiles, the ceiling profile, and the floor profile each comprise a single sheet of metal.

5. The frame according to claim 3, wherein the first cross-sectional shape of the post profile, at least in one cross-section plane, is substantially rectangular with at least one concavity present in two of its adjacent outer walls and each concavity forming the cross-section of a respective slot guide.

6. The frame according to claim 3, wherein the cross section of the slot guide is of dovetail shape and the slot guide is configured to receive the connecting element.

7. The frame according to claim 3, wherein the connecting element comprises a plate configured to engage a mating element within the slot guide.

8. The frame according to claim 2, wherein the hollow head portion and the hollow foot portion of both the ceiling profile and the floor profile are thickened in cross-section and, together with the crosspiece provide each of the ceiling profile and the foot profile with a double-T-shaped cross-sectional profile.

9. The frame according to claim 8, wherein the cross-sectional profile of the foot portion of the floor profile has a greater vertical extent than the cross-sectional profile of the foot portion of the ceiling profile.

10. The frame according to claim 8, further comprising at least one drywall construction profile having a first end and a second end, the first end positioned between the thickened head portion and the thickened foot portion of a ceiling profile or a floor profile, and at least one layer of paneling is affixed to the drywall construction profile.

11. The frame according to claim 10, further comprising an insulation material affixed to the drywall construction profile.

12. The frame according to claim 10, wherein the drywall construction profile and at least on layer of paneling comprises one of a vertical wall, a horizontal ceiling or a horizontal floor.

13. The frame according to claim 10, wherein the head portion, the foot portion and the crosspiece define a space configured to receive in a form-fitting manner the cross-sectional shape of the first end or the second end of the drywall construction profile approximately orthogonally in relation to the crosspiece.

14. A modular framework construction, comprising, a first module having a first frame and a second frame according to claim 1, wherein the first and second frames are arranged spaced apart and parallel to one another, and wherein the first post profile of the first frame is connected to the first post profile of the second frame via a first ceiling profile and a first floor profile, and wherein the second post profile of the first frame is connected to the second post profile of the second frame via a second ceiling profile and a second floor profile to form a first module.

15. The modular framework construction according to claim 14, further comprising a second module having a third frame and a fourth frame, wherein the third frame and fourth frame each comprise two vertical post profiles each having an upper end and a lower end, a ceiling profile and a floor profile, wherein the upper ends of the post profiles are connected to one another via the ceiling profile and the lower ends are connected to one another via the floor profile, and wherein the post profiles have the same cross-sectional shape, and the ceiling profile and the floor profile each have differently configured cross-sectional shapes, and wherein the third and fourth frames are arranged spaced apart and parallel to each other, and wherein the first post profile of the third frame is connected to the first post profile of the fourth frame via a third ceiling profile and a third floor profile and wherein the second post profile of the third frame is connected to the second post profile of the fourth frame via a fourth ceiling profile and a fourth floor profile, and wherein the first and second modules are connected to one another to form a building having at least two rooms or having at least one large room.

16. The modular framework construction according to claim 14, comprising at least one drywall construction profile affixed to and extending orthogonally between two ceiling profiles or extending between two floor profiles and a drywall construction affixed to the at least one drywall construction profile for closing and/or for filling at least one of the surfaces defined by a frame wherein the at least one drywall-construction profile has its respective ends mounted, in a form-fitting manner orthogonally in relation to two mutually opposite, parallel ceiling profiles or floor profiles, in mounts which are at least partially contoured to conform to the at least one drywall-construction profile and belong to said ceiling profiles or floor profiles.

17. A system for modular construction, comprising a plurality of elongate profiles configured to interconnect to each other in a self-supporting manner, the plurality of elongate profiles comprising at least one post profile comprising, a load bearing elongate member having an upper end and a lower end spaced from the upper end, a longitudinal axis defined between the upper and lower ends, a plurality of outer walls extending from the upper end to the lower end and defining a hollow interior, and at least one slot guide disposed within an outer wall and which extends at least over a portion of the longitudinal axis and into the hollow interior of the profile, the at least one slot guide configured to receive at least one connecting element, and wherein when the longitudinal axis of the post profile is oriented vertically the post profile is load bearing, and at least one ceiling or floor profile comprising, an elongate member having a head portion and a foot portion spaced from the head portion, the head portion having a first T-shaped cross-sectional profile and the foot portion having a second T-shaped cross-sectional profile and a crosspiece extending between the first T-shaped cross-sectional profile and the second T-shaped cross-sectional profile, wherein when the profile is oriented horizontally the crosspiece is vertically oriented and the elongate member forms double-T-shape in cross-section.

18. The frame according to claim 8, wherein each of the two post profiles comprises an elongate member having a plurality of outer walls defining an interior space, and at least one slot guide which extends at least over a portion of an outer wall and into the interior space, and further comprising a connecting element disposed within the at least one slot guide and connecting either a ceiling profile or a floor profile to a post profile.

* * * * *